US007914330B2

(12) United States Patent
Su et al.

(10) Patent No.: US 7,914,330 B2
(45) Date of Patent: Mar. 29, 2011

(54) CARD CONNECTOR WITH A METAL SHELL

(75) Inventors: Yu-Hung Su, Tu-Cheng (TW); Yao-Ting Wang, Tu-Cheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 253 days.

(21) Appl. No.: 12/401,618

(22) Filed: Mar. 11, 2009

(65) Prior Publication Data

US 2010/0233911 A1 Sep. 16, 2010

(51) Int. Cl.
*H01R 13/648* (2006.01)

(52) U.S. Cl. ..... 439/607.31

(58) Field of Classification Search ..... 439/629, 439/630, 607.31

See application file for complete search history.

(56) References Cited

U.S. PATENT DOCUMENTS 7,014,481 B2 * 3/2006 Miyamoto ..... 439/95
7,530,852 B2 * 5/2009 Hu et al. ..... 439/630
7,611,385 B1 * 11/2009 Gao et al. ..... 439/630

* cited by examiner

*Primary Examiner* — Edwin A. Leon
*Assistant Examiner* — Vanessa Girardi

(57) ABSTRACT

A card connector adapted for receiving a SIM card includes an insulating housing having a front surface and two opposite lateral surfaces. The front surface has at least one receiving recess extending rearward. Each of the lateral surfaces has a propping portion which passes through a top surface of the insulating housing. A plurality of connecting terminals is received in the insulating housing. The metal shell coupled with the insulating housing has a covering plate and two lateral plates extending downwards from two opposite sides of the covering plate. A front edge of the covering plate has at least one first mating portion of L shape of which a bottom is received in the receiving recess. A bottom of the lateral plate curves inwards to form a resistive portion resting against the propping portion for forming a chamber for receiving the SIM card.

10 Claims, 2 Drawing Sheets

CARD CONNECTOR WITH A METAL SHELL

BACKGROUND OF THE INVENTION

1. Field of the Invention

The present invention relates to a connector, and more particularly to a card connector adapted for receiving a subscriber identity module (SIM) card.

2. The Related Art

In recent years, with the ever-improving miniaturization and multifunction of consumer electronic products, such as mobile phones, digital cameras and the like, a large quantity of internal components mounted in the consumer electronic products are designed to be much smaller and thinner, and much more reliable. A card connector mounted in the consumer electronic products for electrically connecting with a SIM card has a compact size and a light weight and has been used popularly. The conventional card connector has an insulting housing, a plurality of connecting terminals mounted in the insulating housing and a metal shell coupled with the insulting housing to form a chamber receiving a part of the SIM card for reducing the occupied space thereof. However, such structure can not be assured to remain a steady connection between the connecting terminals and the SIM card when affected by an unexpected force and shock.

SUMMARY OF THE INVENTION

Accordingly, an object of the present invention is to provide a card connector having a biggish receiving chamber for receiving a card with a small volume.

A card connector adapted for receiving a SIM card includes an insulating housing having a front surface and two opposite lateral surfaces. The front surface has at least one receiving recess extending rearward. Each of the lateral surfaces has a propping portion showing in a form of a recess which passes through a top surface of the insulating housing. A plurality of connecting terminals is received in the insulating housing. A metal shell coupled with the insulating housing has a covering plate and two lateral plates extending downwards from two opposite sides of the covering plate. A front edge of the covering plate extends downwards and bends rearwards to form at least one first mating portion of L shape of which a bottom is received in the receiving recess. A bottom of the lateral plate curves inwards to form a resistive portion resting against the propping portion for forming a chamber for receiving the SIM card.

As described above, the resistive portion is located on the propping portion to form the chamber of which a height can be adjusted and which can substantially completely receive the inserted SIM card. Furthermore, the bottom of the first mating portions are received in the receiving recesses, which is able to fix the metal shell to the insulating housing firmly and reduce the occupied space of the card connector and then form the biggish receiving chamber for receiving the inserted card with a small volume so as to remain the steady connection between the connecting terminals and the inserted card when affected by an unexpected force and shock.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENTS

Figure 1:
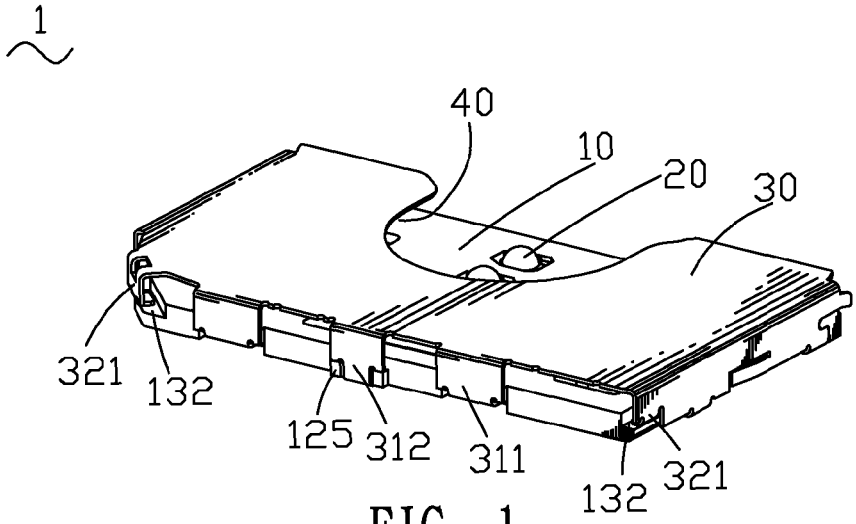
FIG. 1 is an assembled view of a card connector in a first embodiment according to the present invention.

With reference to FIG. 1, a card connector 1 of an embodiment according to the present invention is shown. The card connector 1 includes an insulating housing 10, a plurality of connecting terminals 20 and a metal shell 30.

Figure 2:
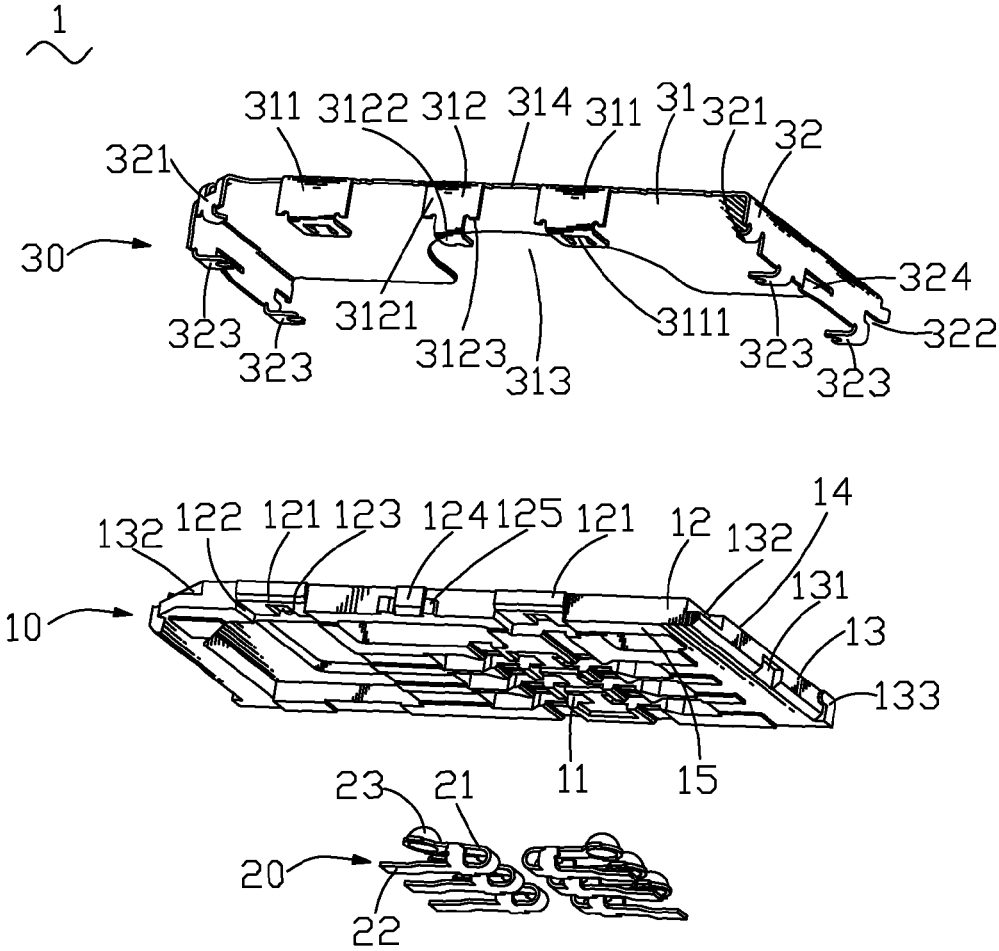
FIG. 2 is an exploded view of the card connector shown in FIG. 1.

Please refer to FIG. 1 and FIG. 2, the insulating housing 10 is substantially a rectangular flat-board shape and defines a front surface 12, two opposite lateral surfaces 13, a top surface 14 and a bottom surface 15. The bottom surface 15 of the insulating housing 10 has a plurality of terminal recesses 11 reaching the top surface 14 of the insulating housing 10 for receiving the connecting terminals 20. The front surface 12 of the insulating housing 10 is protruded frontward to form two first engaging portions 121 apart from each other. The first engaging portion 121 extends leftward and rightward to show a substantial bar shape. A top of the first engaging portion 121 is flush with the top surface 14. A portion of the front surface 12 under the first engaging portion 121 is recessed rearward to form a receiving recess 122. The receiving recess 122 passes through the bottom surface 15 and has a buckling groove 123 at an upper wall thereof. The front surface 12 further has a second engaging portion 124 of substantially rectangular shape protruded frontward therefrom and located between the two first engaging portions 121 and two first propping portions 125 respectively connecting with two opposite sides of the second engaging portion 124. The first propping portion 125 has a top surface connected to a substantially middle portion of the second engaging portion 124, and a front surface exceeding that of the second engaging portion 124 with a predetermined distance.

The lateral surface 13 has a stopping groove 131 at a middle thereof. The stopping groove 131 reaches the bottom surface 15 of the insulating housing 10. One end of the lateral surface 13 is concaved inwards to form a second propping portion 132, showing in the form of a recess and passing through the top surface 14 and the front surface 12. The other end of the lateral surface 13 is protruded outwards to form a stopping portion 133. The stopping portion 133 is substantially an inverted-L shape with respect to the stopping groove 131.

Referring to FIG. 2, the connecting terminal 20 has a U-shaped basic portion 21, a soldering portion 22 extending obliquely and downwards from one end of the basic portion 21, and a contacting portion 23 extending upwards from the other end of the basic portion 21. The basic portion 21 is received in the terminal recess 11. The soldering portion 22 exceeds the bottom surface 15 for being soldered on a printed circuit board (PCB, not shown). The contacting portion 23 is substantially a dome shape and extends resiliently above the top surface 14 for electrically connecting with an inserted SIM card (not shown).

With reference to FIG. 2, the metal shell 30 coupled with the insulating housing 10 defines a covering plate 31 and two lateral plates 32 which extend downwards from two opposite sides of the covering plate 31 and flank the two lateral surfaces 13 of the insulating housing 10. The covering plate 31 is substantially an oblong shape. A front edge 314 of the covering plate 31 extends downwards and then bends rearward to form two first mating portions 311 and a second mating portion 312 between the first mating portions 311. The first mating portions 311 and the second mating portion 312 are all L shape with respect to the covering plate 31. A bottom at the free end of the first mating portion 311 may be punched inwards to form a buckling piece 3111 corresponding to the buckling groove 123. The second mating portion 312 includes a first section 3121 extending upwards and downwards and a second section 3122 intersecting with the first section 3121. The second section 3122 is narrower than the first section 3121. Both lower sides of the first section 3121 are narrowed to form a first resistive portion 3123, respectively, located on the first propping portion 125. A rear edge of the covering plate 30 defines an indentation 313 of semi-circle shape for conveniently inserting or extracting the SIM card.

Each of the lateral plates 32 has a second resistive portion 321 at a front end thereof. The second resistive portion 321 is curved inwards as a hook shape and located on the second propping portion 132. A rear end of the lateral plate 32 defines a fixing groove 322 at a lower portion thereof for mating with the stopping portion 133 of the insulating housing 10 for preventing the metal shell 30 from moving rearwards and downwards. Two fixing pieces 323 are extended inwards from a bottom of the lateral plate 32 and adjacent to the second resistive portion 321 and the fixing groove 322, respectively. The fixing pieces 323 are disposed at the same level as the second section 3122. A portion of the lateral plate 32 between the fixing pieces 323 may be punched inwards to form a buckling latch 324 of strip shape corresponding to the stopping groove 131.

Please refer to FIG. 1 and FIG. 2, in assembly, the connecting terminals 20 are respectively received in the terminal recesses 11 of the insulating housing 10. The insulating housing 10 is inserted into the metal shell 30 from a rear direction. The bottom of the first mating portions 311 are received in the receiving recesses 122, and the second section 3122 and the fixing pieces 323 all button the bottom surface 15 of the insulating housing 10 to prevent the metal shell 30 from separating from the insulating housing 10. The buckling pieces 3111 and the buckling latches 324 are inserted in the corresponding buckling grooves 123 and stopping grooves 131. The stopping portions 133 are mated with the fixing grooves 322 for preventing the metal shell 30 from moving with respect to the insulating housing 10. Moreover, the first engaging portions 121 and the second engaging portion 124 rest against the first mating portions 311 and the second mating portion 312 for further fastening the metal shell 30 and the insulating housing 10 together. The first resistive portions 3123 and the second resistive portions 321 are respectively located on the first propping portions 125 and the second propping portions 132 for supporting the metal shell 30 and forming a chamber 40 for receiving the SIM card.

Figure 3:
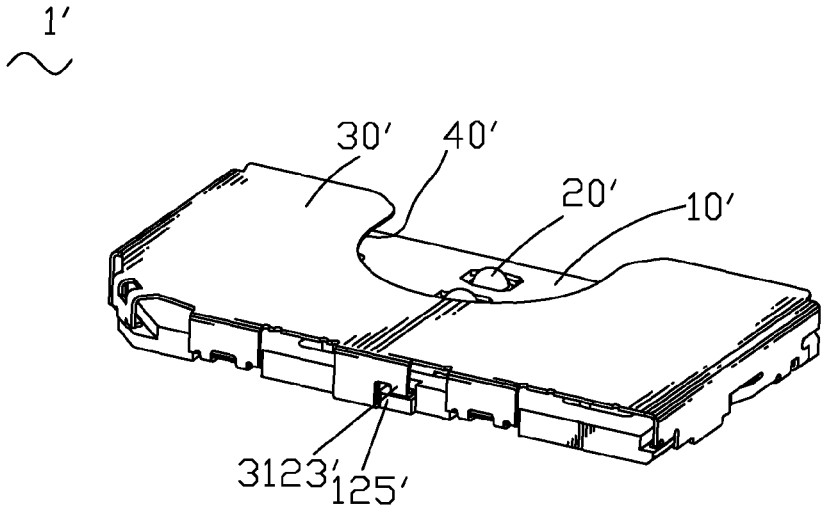
FIG. 3 is an assembled view of a card connector in a second embodiment according to the present invention.
Figure 4:
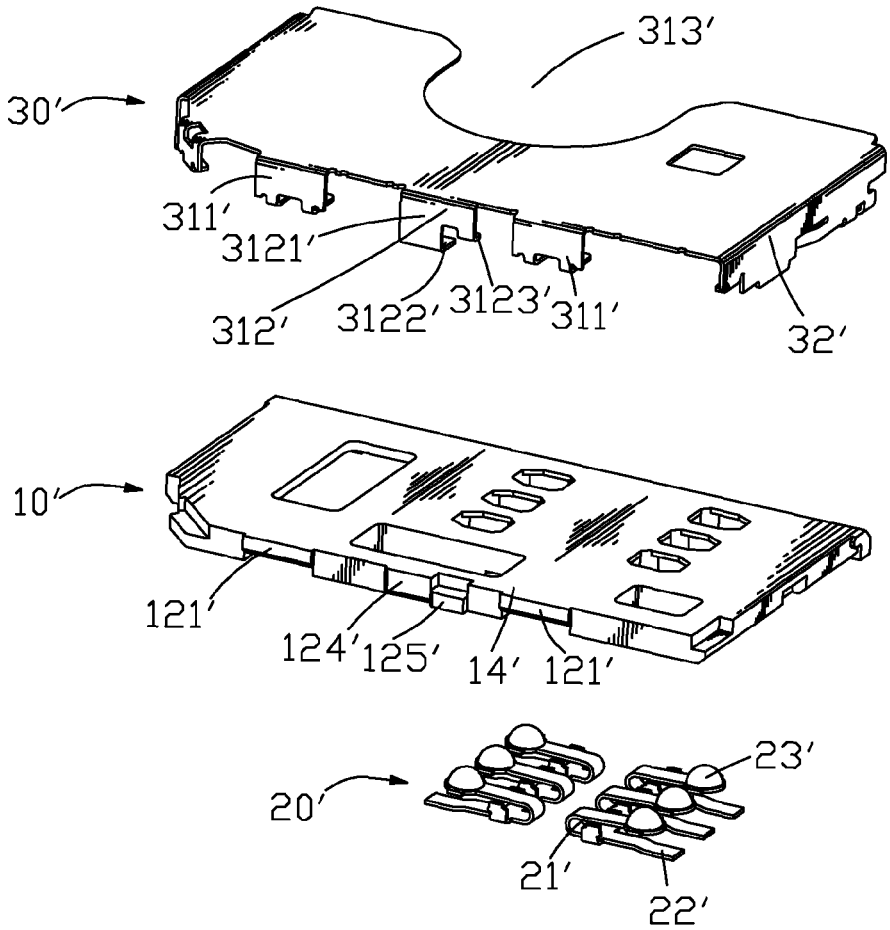
FIG. 4 is an exploded view of the card connector shown in FIG. 3.

Please referring to FIG. 3 and FIG. 4, a card connector 1' in accordance with the second embodiment of the present invention is illustrated. In comparison with the first embodiment of the present invention, the structure of the card connector 1' is same as that of the card connector 1 except for the second mating portion 312' and the first propping portion 125'. The second mating portion 312' has the rectangular first section 3121' and the second section 3122' bent inwards from a bottom end of the first section 3121'. The first resistive portion 3123' is connected with a side of the first section 3121' and shows an L shape with respect to the covering plate 31', with a bottom thereof higher than the second section 3122'. The insulating housing 10' has a portion adjacent to the second engaging portion 124' concaved inwards and through the top surface 14' to form the first propping portion 125'. The first propping portion 125' supports the first resistive portion 3123' for forming the chamber 40' to receive the inserted SIM card and preventing the metal shell 30' from moving downwards when affected by an unexpected force.

As described above, the first resistive portions and the second resistive portions are respectively located on the first propping portions and the second propping portions to form the chamber of which a height can be adjusted and which can substantially completely receive the inserted SIM card. Furthermore, the first mating portions are received in the receiving recesses, the second section and the fixing pieces all button the bottom surface of the insulating housing, and the buckling pieces and the buckling latches are inserted in the corresponding buckling grooves and stopping grooves, and the stopping portions are mated with the fixing grooves, which is able to fix the metal shell to the insulating housing firmly and reduce the occupied space of the card connector.

What is claimed is:

1. A card connector adapted for receiving a card, comprising:

an insulating housing defining a front surface and two opposite lateral surfaces, the front surface having at least one receiving recess extending rearward and passing through a bottom surface of the insulating housing, each of the lateral surfaces having a propping portion showing in the form of a recess which passes through a top surface of the insulating housing;

a plurality of connecting terminals received in the insulating housing; and a metal shell coupled with the insulating housing having a covering plate and two lateral plates extending downwards from two opposite sides of the covering plate, a front edge of the covering plate extending downwards and bending rearwards to form at least one first mating portion of L shape of which a bottom is received in the receiving recess, a bottom of the lateral plate curving inwards to form a resistive portion resting against the propping portion for forming a chamber for receiving the card.

2. The card connector as claimed in claim 1, wherein the lateral surface of the insulating housing has a stopping groove adjacent to the propping portion for receiving a buckling latch formed at a bottom of the lateral plate for preventing the metal shell from moving rearward.

3. The card connector as claimed in claim 1, wherein the covering plate has an indentation of semi-circle shape at a rear thereof for convenient insertion and withdrawal.

4. The card connector as claimed in claim 1, wherein the front surface of the insulating housing is protruded frontward to form an engaging portion and two first propping portions disposed at lower portions of two opposite sides of the engaging portion, the cover plate has a second mating portion of L shape extended from the front edge thereof, the second mating portion includes a first section extending from the front edge of the cover plate and a second section intersecting with the first section, the first section has two lower sides narrowed to form two first resistive portions resting against the corresponding first propping portions.

5. The card connector as claimed in claim 4, wherein the front surface of the insulating housing protrudes outwards to form a first engaging portion above the receiving recess and against the first mating portion.

6. The card connector as claimed in claim 1, wherein the propping portion is disposed at a front of the lateral surface of the insulating housing and passes through the front surface and a top surface of the insulating housing.

7. The card connector as claimed in claim 6, wherein a rear end of the lateral surface is protruded outwards to form a stopping portion of inverted-L shape with respect to the propping portion, the lateral plate of the metal shell correspondingly has a fixing groove mating with the stopping portion for preventing the metal shell from moving rearward and downwards.

8. The card connector as claimed in claim 1, wherein the front surface of the insulating housing has a portion concaved inwards and passing through the top surface of the insulating housing to form a first propping portion, the front edge of the metal shell is extended downwards and bent inwards to form a first resistive portion resting against the first propping portion for supporting the metal shell to form the chamber.

9. The card connector as claimed in claim 8, wherein the front edge of the metal shell is extended downwards and bent inwards to form a second mating portion connecting with the first resistive portion, with a bottom thereof lower than that of the first resistive portion, for buttoning a bottom of the insulating housing.

10. The card connector as claimed in claim 9, wherein the front surface of the insulating housing is protruded outwards to form an engaging portion adjacent to the first propping portion and against the second mating portion for fastening the metal shell to the insulating housing.

* * * * *